US008519307B2

(12) United States Patent
Schumacher et al.

(10) Patent No.: US 8,519,307 B2
(45) Date of Patent: Aug. 27, 2013

(54) MODULAR PAINT OVEN USING RADIANT AND CONVECTION HEAT

(75) Inventors: James C. Schumacher, Royal Oak, MI (US); Curt D. Hite, Chesterfield Township, MI (US); Tracy E. Roberts, Shelby Township, MI (US)

(73) Assignee: GK Licensing, LLC, Detroit, MI (US)

( * ) Notice: Subject to any disclaimer, the term of this patent is extended or adjusted under 35 U.S.C. 154(b) by 284 days.

(21) Appl. No.: 13/087,707

(22) Filed: Apr. 15, 2011

(65) Prior Publication Data

US 2012/0263442 A1 Oct. 18, 2012

(51) Int. Cl.

| | |
|---|---|
| ***F27B 9/06*** | (2006.01) |
| ***F27B 9/34*** | (2006.01) |
| ***F27B 9/36*** | (2006.01) |
| ***F27D 7/04*** | (2006.01) |
| ***F27D 15/00*** | (2006.01) |

(52) U.S. Cl.
USPC ..... 219/388; 432/152; 432/176; 34/270

(58) Field of Classification Search
None
See application file for complete search history.

(56) References Cited

U.S. PATENT DOCUMENTS

| | | | | | |
|---|---|---|---|---|---|
| 2,688,685 | A | * | 9/1954 | Goodell | 392/414 |
| 3,106,751 | A | | 10/1963 | Fish | |
| 3,459,921 | A | | 8/1969 | Fussell et al. | |
| 3,884,413 | A | | 5/1975 | Berquist | |
| 4,311,460 | A | * | 1/1982 | Lauersdorf et al. | 432/247 |
| 4,546,553 | A | | 10/1985 | Best | |
| 4,764,108 | A | * | 8/1988 | Carthew et al. | 432/128 |
| 4,785,552 | A | | 11/1988 | Best | |
| 4,878,480 | A | | 11/1989 | Watson et al. | |
| 5,060,594 | A | * | 10/1991 | Tomioka et al. | 118/666 |
| 5,230,161 | A | | 7/1993 | Best | |
| 5,303,660 | A | * | 4/1994 | Lauersdorf | 110/336 |
| 5,309,650 | A | | 5/1994 | Josefsson et al. | |
| 5,475,958 | A | | 12/1995 | Josefsson et al. | |
| 5,568,692 | A | | 10/1996 | Crompton et al. | |
| 5,588,830 | A | | 12/1996 | Josefsson et al. | |
| 5,661,912 | A | | 9/1997 | Bhatnagar et al. | |
| 5,823,767 | A | | 10/1998 | Watanabe et al. | |
| 5,836,085 | A | | 11/1998 | Ben-Ezra | |
| 6,074,206 | A | * | 6/2000 | Lauersdorf | 432/251 |
| 6,769,909 | B2 | * | 8/2004 | Schwartz | 432/175 |
| 6,863,929 | B2 | | 3/2005 | Watanabe et al. | |
| 6,990,749 | B2 | | 1/2006 | Roesler et al. | |
| 7,063,528 | B2 | | 6/2006 | Klobucar et al. | |
| 7,416,406 | B2 | * | 8/2008 | Schubach | 432/251 |
| 7,740,912 | B2 | | 6/2010 | Uhlianuk et al. | |
| 8,186,119 | B1 | * | 5/2012 | Huff et al. | 52/506.03 |
| 8,367,978 | B2 | * | 2/2013 | Williams | 219/388 |
| 8,393,895 | B2 | * | 3/2013 | Schwartz et al. | 432/124 |
| 2006/0068094 | A1 | | 3/2006 | Cole | |
| 2008/0099459 | A1 | * | 5/2008 | Williams | 219/388 |
| 2010/0038353 | A1 | | 2/2010 | Schwartz et al. | |

* cited by examiner

*Primary Examiner* — Joseph M Pelham
(74) *Attorney, Agent, or Firm* — Dickinson Wright PLLC

(57) ABSTRACT

An oven apparatus 24 having a modular construction for curing paint on the surface of a vehicle body 26 using radiant and convection heat. The oven apparatus 24 includes a plurality of oven modules 30. Each oven module 30 includes a pair of convection return air assemblies 128 for removing exhaust gases from the oven interior 98 and a pair of radiant heating tubes 100 for heating the vehicle body. Each of the convection return air assemblies 128 has a reflective outer surface 94 for reflecting radiant heat from the radiant heating tubes 100 at the vehicle body 26.

17 Claims, 4 Drawing Sheets

MODULAR PAINT OVEN USING RADIANT AND CONVECTION HEAT

BACKGROUND OF THE INVENTION

1. Field of the Invention

The subject invention relates to an oven apparatus having a modular construction for curing paint on the surface of a vehicle body utilizing radiant and convection heat.

2. Description of the Prior Art

Ovens having a modular construction for curing paint on the surface of a vehicle are known in the art. One such oven is illustrated in U.S. Pat. No. 6,990,749 to Roesler et al. wherein a plurality of oven modules, each having an interior, extend along an axis and have a length. Further, it is known in the art to include radiant tubes in paint curing ovens for heating vehicle bodies and reflectors for reflecting radiant heat at the vehicle bodies. One such oven is illustrated in U.S. Pat. No. 6,769,909 issued to Glen N Schwartz. Moreover, it is known for ovens to include convection return air assemblies having an outer surface and disposed in the interior of an oven. One such oven is illustrated in U.S. Pat. No. 5,588,830 issued to Josefsson et al. The prior art includes separate reflector and convection return air assemblies.

SUMMARY OF THE INVENTION

The invention provides for such an oven apparatus wherein the convection return air assembly is disposed adjacent to the base and one of the side walls with the return air outer surface of the convection return air assembly extending in a trough shape to define a channel partially surrounding the radiant heating tube for reflecting radiant heat from the radiant tube toward the lower part of the vehicle body.

ADVANTAGES OF THE INVENTION

Thus several advantages of one or more aspects of the invention are that it provides for an inexpensive, easily-assembled, easily-maintained and compact structure for reflecting heat from radiant heating tubes at a vehicle body and for removing return air from an oven interior. The invention uses fewer parts and requires less time to assemble than the separate return air and reflector assemblies of the prior art, therefore reducing capital and assembly expenses and providing for a structure that is easier to assemble. Further, the fact that the invention uses fewer parts than the prior art makes the invention less prone to error during assembly and operation and also easier to maintain. Moreover, the integrated assembly of the invention uses significantly less space in the oven interior than the prior art, therefore providing for a more compact assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
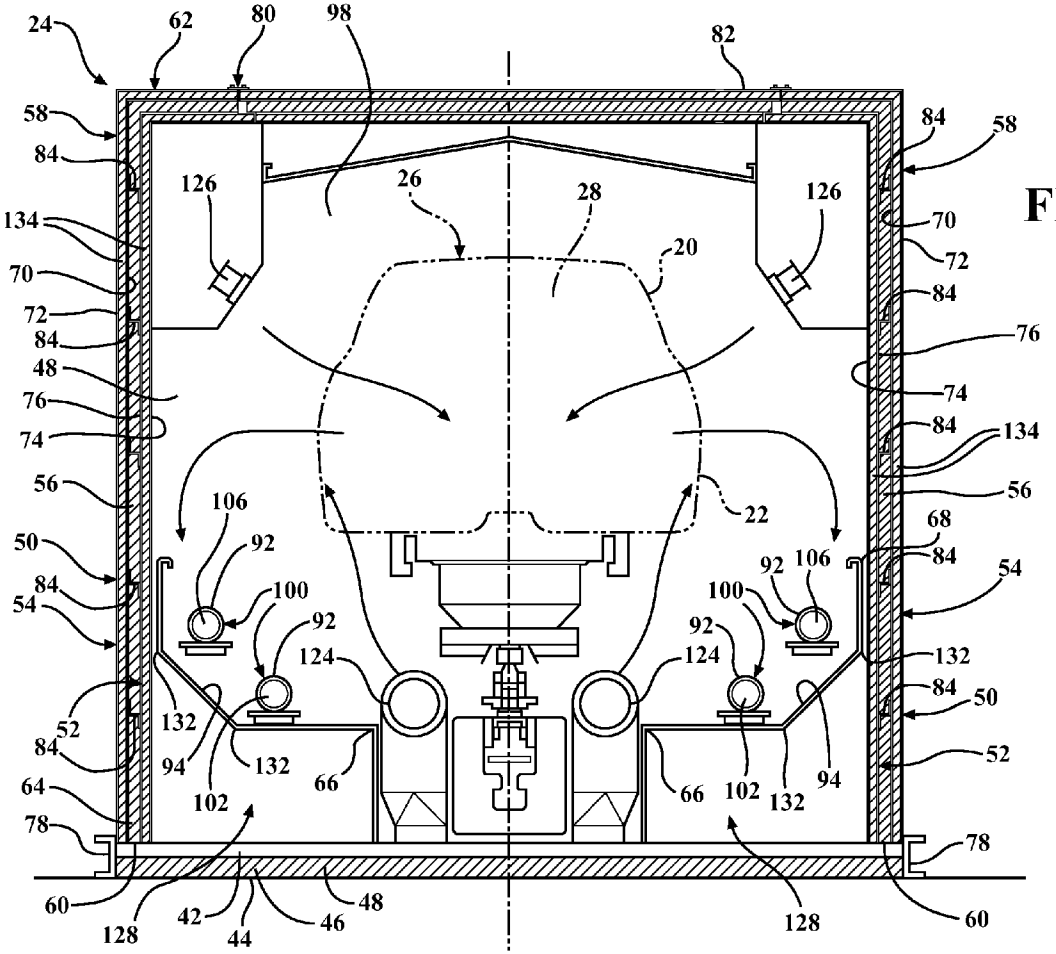
FIG. 1 is a side view of the oven apparatus.
Figure 2:
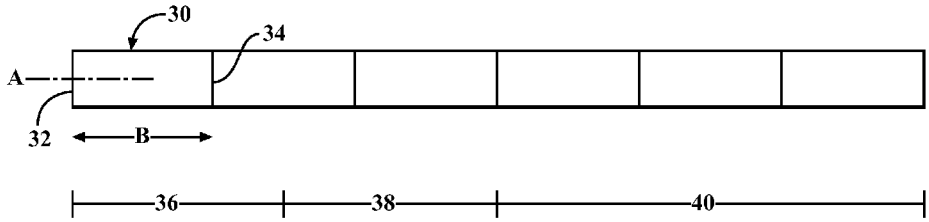
FIG. 2 is a side view of the oven apparatus.

Referring to the Figures, wherein like numerals indicate corresponding parts throughout the several views, an oven apparatus 24 for a curing paint on the surface of a vehicle body 26 having an upper part 20 and a lower part 22 and a vehicle interior 28 is generally shown.

The oven apparatus 24 includes a plurality of oven modules 30, wherein each of the oven modules 30 extends along an axis A and has a length B. It should be appreciated that the length B of each oven modules 30 can vary depending on its drying application. Each oven module 30 includes a fixed end 32 and an expanding end 34, wherein the expanding end 34 accommodates axial expansion and contraction caused by heat in the oven modules 30. Each of the oven modules 30 is disposed in serial relationship with one another, and combinations of oven modules 30 define zones 36, 38, 40 corresponding to different baking applications. In the enabling embodiment, one and a half oven modules 30 define a heat-up zone 36, one and half oven modules 30 define an equalization zone 38, and three oven modules 30 define a hold zone 40. It should be appreciated that more or fewer oven modules 30 can be used to comprise different zones 36, 38, 40 to accommodate various paint drying processes.

Each of the oven modules 30 includes a base 42. A structural member 44 is disposed below the base 42 to define a base cavity 46 between the base 42 and the structural member 44. A base insulating material 48 is disposed in the base cavity 46 for restricting heat loss from the base 42. It should be appreciated that various types of insulation could be disposed in the base cavity 46. Further, each of the oven modules 30 includes a pair of walls 50 extending up from the base 42. Each wall 50 includes an interior shell 52, an outer shell 54 and a wall cavity 56 therebetween. In the enabling embodiment, the outer shell 54 and the interior shell 52 each have a shell interior 134. However, it should be appreciated the outer and interior shells 54, 52 could be solid panels. Each of the walls 50 has a wall top end 58 and a wall bottom end 60, where the bottom end engages the base 42. The wall top ends 58 form an L-shape and extends parallel to the base 42 to define a ceiling 62. In the enabling embodiment, the walls 50 and ceiling 62 are constructed of aluminized sheet metal for heat and corrosion resistance. However, it should be appreciated that other wall 50 materials could be used. A shell insulating material 64 is disposed in the shell interior 134 of the outer and interior shells 54, 52 as well as in the wall cavity 56 to define three layers of insulation for restricting heat loss from the walls 50 and the ceiling 62. The seams of the shell insulating material 64 are staggered for reducing concentrated areas of heat on the wall 50 and ceiling 62. The L-shaped top ends 58 advantageously prevent air from escaping from the upper corners of the oven modules 30. Further, the interior shell 52 is seal-welded at all joints to prevent oven air from escaping.

The outer shell 54 has an outer shell inner surface 70 and an outer shell outer surface 72 and the interior shell 52 has an interior shell inner surface 74 and an interior shell outer surface 76. A pair of C-shaped channels 78 are disposed on opposing sides of each of the oven modules 30. The C-shaped channels 78 extend along the length B of the module and engage the base 42 and the structural member 44 and the outer shell outer surface 72. The C-shaped channels 78 are used to provide support during shipping and installation.

A plurality of rectangular shaped openings 80 are axially spaced across the ceiling 62 of the oven modules 30. A corresponding rectangular shaped explosion relief plug 82 is sealingly disposed in each of the openings 80. In the enabling embodiment, the explosion relief plug 82 includes three seals, however it should be appreciated that any number of seals could be used.

Figure 3:
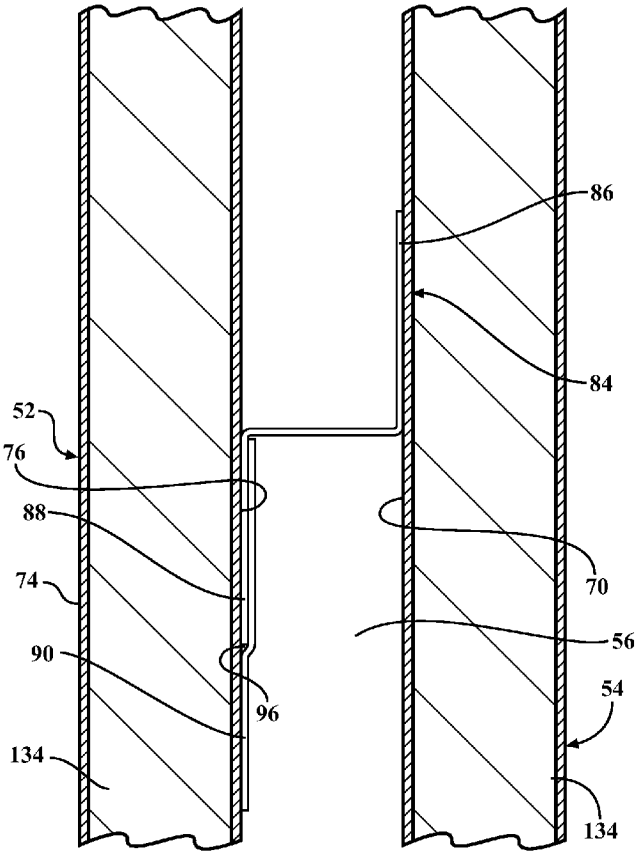
FIG. 3 is a view of the partially broken away support clip and wall assembly.
Figure 4:
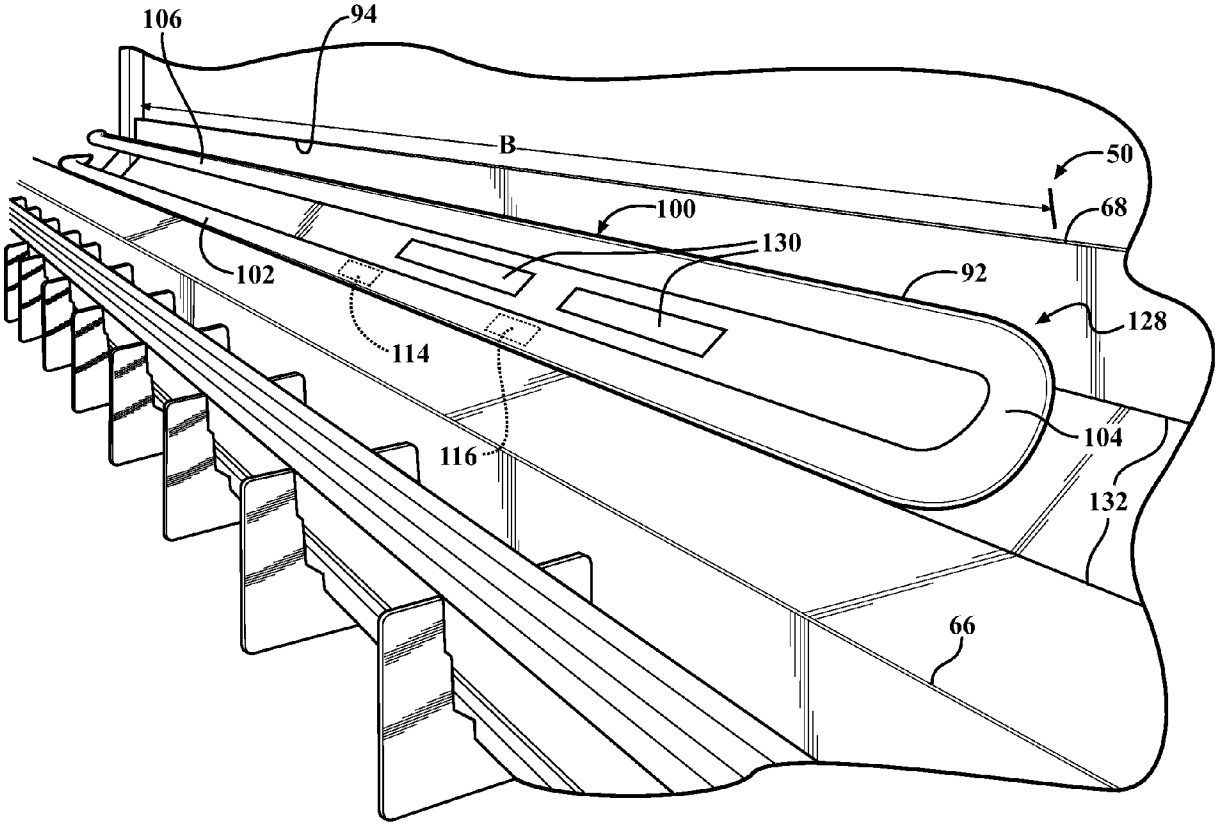
FIG. 4 is perspective view of the oven interior.

As best shown in FIG. 3, a plurality of Z-shaped rails 84 are disposed in the wall cavity 56 and extend axially along the length B of each oven module 30. Each of the Z-shaped rails 84 has a first rail leg 86 and a second rail leg 88. The first rail legs 86 of the Z-shaped rails 84 fixedly engages outer shell inner surface 70. A plurality of support clips 90 are disposed in the wall cavity 56 and axially extend along the length B of each of the oven modules 30. The support clips 90 fixedly engage the interior shell outer surface 76. In the enabling embodiment, the first rail leg 86 of the Z-shaped rails 84 and the support clips 90 are welded to their respective shell surfaces 70, 76. However, it should be appreciated that they could be attached in other ways. Each of the support clips 90 includes a clip cavity 96 for receiving the second rail leg 88 of a Z-shaped rail 84. The second rail leg 88 of the Z-shaped rail 84 axially slides in the clip cavity 96 of the support clip 90 to allow axial movement between the interior and outer shells 52, 54 while restricting transverse motion between the interior and outer shells 52, 54. Axial movement between the interior and outer shells 52, 54 is advantageous because it prevents leaks from forming at connection points and seams of the oven walls 50. Further, the three layers of shell insulating material 64 are able to axially move independently from one another, preventing settling and compression of the shell insulating material 64, thus reducing areas oven concentrated heat on the oven walls. Limiting transverse motion between the interior and outer shells 52, 54 is advantageous because it restricts transverse compression of the shell insulating material 64, also preventing areas of concentrated heat on the walls 50.

An oven interior 98 of each oven module 30 is defined by the base 42, walls 50 and the ceiling 62. A pair of U-shaped radiant heating tubes 100 are disposed in each of the oven modules 30 for heating the oven interior 98. Each of the radiant heating tubes 100 includes a first tube leg 102 entering one of the oven module 30 ends 32, 34 at a 45 degree angle. The radiant heating tube 100 then extends axially along the oven module 30 length B to form a U-shaped portion 104 adjacent one of the ends 32, 34 of the oven module 30. A second tube leg 106 extends back along the oven length B and exits the oven module 30 adjacent to the first tube leg 102. The first tube leg 102 of each of the radiant heating tubes 100 is positioned lower than the second tube leg 106 of the radiant heating tube 100. Each of the radiant heating tubes 100 has a tube outer surface 92 and a wall thickness of at least 0.25 inches for explosion resistance. In the enabling embodiment, each of the radiant heating tubes 100 is constructed of steel with raw steel exposed for providing emissivity in the range of 0.85 to 0.90. However, It should be appreciated that the radiant heating tubes 100 could be constructed of other materials to vary the emissivity of their outer surfaces 92.

Figure 5:
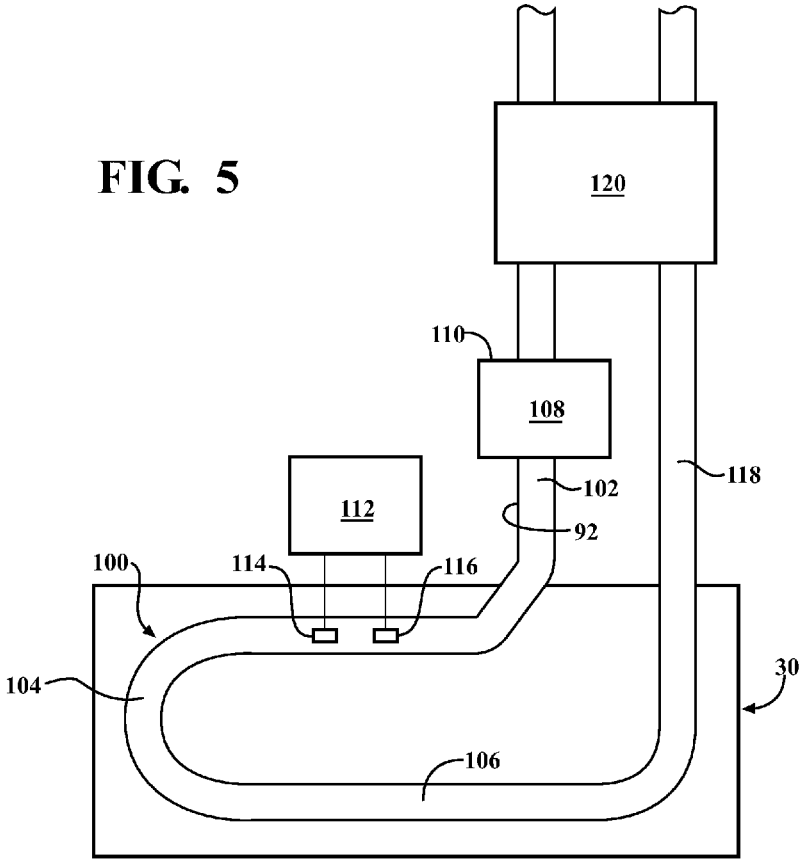
FIG. 5 is a schematic illustration of the heat exchanger, control system and burner arrangement.

As best shown in FIG. 5, a natural gas burner 108 is disposed outside of each of the oven modules 30 for providing heat to the radiant heating tubes 100. The natural gas burner 108 includes a burner inlet 110 for receiving air. The first tube leg 102 of each of the radiant heating tubes 100 is connected to the natural gas burner 108. Further, a control system 112 is connected to the natural gas burners 108 for firing the burner with pulse control or high/low control. It should be appreciated that the control system 112 could have various settings for different baking processes. A plurality of temperature control sensors 114 engage the tube outer surface 92 of each of the radiant heating tubes 100. The temperature control sensors 114 are in communication with the control system 112 for monitoring the temperature of the tube outer surface 92 of the radiant tubes. Further, at least one high temperature sensor 116 engages the tube outer surface 92 and is in communication with the control system 112 for disabling the natural gas burner 108 when a predetermined maximum temperature is reached. The temperature control and high temperature sensors 114, 116 are welded to the tube outer surface 92 of the radiant heating tubes 100. However, it should be appreciated that the sensors 114, 116 could be attached by other means.

Figure 6:
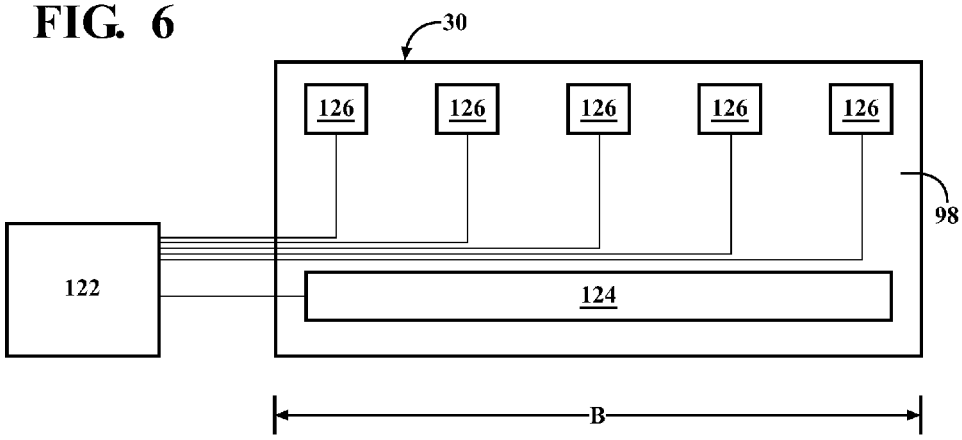
FIG. 6 is a schematic illustration of the convection air heater and convection duct arrangement.

Upon exiting the oven module 30, the second tube leg 106 defines an exhaust outlet 118. A heat exchanger 120 is disposed outside of each of the oven modules 30 and is in fluid communication with the exhaust outlet 118 and the natural gas burner 108 for transferring heat from the exhaust air from the exhaust outlet 118 to the air entering the burner inlet 110 of the natural gas burner 108 to provide for a more efficient heating process. As best shown in FIG. 6, a convection air heater 122 is disposed outside of each of the oven modules 30 for providing heated convection air to the oven interior 98. A pair of lower convection ducts 124 are disposed above the base 42 and extend along the length B of each of the oven modules 30. The lower convection ducts 124 are connected to the convection air heater 122 for directing heated convection air at a lower temperature than the radiant heating tubes 100 at the lower part 22 of the vehicle body 26. The lower convection ducts 124 also prevent radiant heat from the radiant heating tubes 100 from overheating the vehicle body 26.

A plurality of upper convection ducts 126 are disposed in at least one of the oven modules 30 adjacent to the walls 50 and the ceiling 62 of each of the oven modules 30. The upper convection ducts 126 are connected to the convection air heater 122 for directing heated convection air at the upper part 20 of the vehicle body 26 and for directing heat at the vehicle interior 28 to equalize the temperature profile of the vehicle body 26. It should be appreciated that one or more ceiling fans could be located in the oven interior 98 to provide convection heat, wherein the motors of the ceiling fans are disposed outside of the oven modules 30.

A pair of convection return air assemblies 128 are disposed in each of the oven modules 30 on opposing sides and adjacent to the walls 50 and the base 42. The convection return air assemblies 128 extend axially along the length B of each of the oven modules 30. A plurality of return air ducts 130 are disposed on the convection return air assembly 128 for removing exhaust air from the oven interior 98. Each convection return air assembly 128 has a return air outer surface 94. The return air outer surface 94 of the convection return air assembly 128 is reflective for reflecting radiant heat from the radiant tubes at the lower part 22 of the vehicle body 26 for increased heating efficiency. The return air outer surface 94 extends from a first outer surface end 66 to a pair of bends 132 to a second outer surface end 68 to partially surround the radiant heating tubes 100 for directing radiant heat at the lower part 22 of the vehicle body 26.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the oven apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. An oven apparatus (24) for curing paint on the surface of a vehicle body ((26)) comprising;

at least one oven module (30) extending along an axis (A) parallel to the direction in which the vehicle body (26) moves when passing through said oven module (30), said oven module (30) defining an oven interior (98), said oven module (30) including a base (42) and a pair of walls (50) extending vertically away from said base (42) in spaced relationship with one another, at least one radiant heating tube (100) disposed in said oven module (30) for heating the vehicle body (26), at least one convection return air assembly (128) disposed in said oven interior (98) of said oven module (30) and defining a passage for removing gases from said oven interior (98), said convection return air assembly (128) having a return air outer surface (94), said return air outer surface (94) defining at least one return air duct (130) into said passage for removing exhaust air from said oven interior (98), and characterized by, said convection return air assembly (128) being disposed adjacent to said base (42) and one of said side walls (50) with said return air outer surface (94) of said convection return air assembly (128) extending in a trough shape to define a channel partially surrounding said radiant heating tube (100) for reflecting radiant heat from said radiant tube (100) toward the lower part (22) of the vehicle body (26).

2. The oven apparatus (24) as set forth in claim 1 including a pair of said radiant heating tubes (100) disposed in each of said oven modules (30) each on opposing sides and extending axially along each of said oven modules (30), and a pair of said convection return air assemblies (128) disposed in each of said oven modules (30) on opposing sides and adjacent to said walls (50) and said base (42) and extending axially along each of said oven modules (30).

3. The oven apparatus (24) as set forth in claim 2 wherein said return air outer surface (94) extends from a horizontal surface being parallel to said base (42) to a first bend to an intermediate surface extending at an angle from said horizontal surface to a second bend to a vertical surface being parallel to said wall (50) to define said channel.

4. The oven apparatus (24) as set forth in claim 3 wherein each of said radiant heating tubes comprises a first tube leg (102) disposed adjacent to said first bend of said return air outer surface (94) and a second tube leg (106) disposed adjacent to said second bend of said return air outer surface (94).

5. The oven apparatus (24) as set forth in claim 4 wherein each of said pairs of radiant heating tubes (100) has a U-shape.

6. The oven apparatus (24) as set forth in claim 5 wherein a structural member (44) is disposed below said base (42) of each of said oven modules (30) to define a base cavity (46) between said base (42) and said structural member (44) of each of said oven modules (30).

7. The oven apparatus (24) as set forth in claim 6 wherein a base insulating material (48) is disposed in said base cavity (46) for restricting heat loss from said base (42).

8. The oven apparatus (24) as set forth in claim 7 wherein each of said oven modules (30) includes an interior shell (52) and an outer shell (54) defining said pair of walls (50) and wherein said walls (50) have a wall top end (58) and a wall bottom end (60).

9. The oven apparatus (24) as set forth in claim 8 wherein said outer and interior shells (54, 52) are spaced from one another to define a wall cavity (56) therebetween.

10. The oven apparatus (24) as set forth in claim 9 wherein said wall bottom ends (60) engage said base (42).

11. The oven apparatus (24) as set forth in claim 10 wherein a ceiling (62) extends between said wall top ends (58) parallel to said base (42).

12. The oven apparatus (24) as set forth in claim 11 wherein said base (42) and said pair of walls (50) and said ceiling (62) define said oven interior (98).

13. The oven apparatus (24) as set forth in claim 12 wherein said outer shell (54) defines an outer shell inner surface (70) and an outer shell outer surface (72) and said interior shell (52) defines an interior shell inner surface (74) and an interior shell outer surface (76).

14. The oven apparatus (24) as set forth in claim 13 wherein a pair of C-shaped channels (78) are disposed on opposing sides of said oven modules (30) and extend along each of said oven modules (30) and engage said base (42) and said structural member (44) and said outer shell outer surface (72) for providing support during shipping and installation.

15. The oven apparatus (24) as set forth in claim 14 wherein a plurality of Z-shaped rails (84) are disposed in said wall cavity (56) and axially extend along said oven modules (30).

16. The oven apparatus (24) as set forth in claim 11 wherein said wall top ends (58) form an L-shape to define said ceiling (62).

17. An oven apparatus (24) for a curing paint on the surface of a vehicle body (26) having an upper part (20) and a lower part (22) and an interior comprising;

a plurality of oven modules (30), each of said oven modules (30) extending along an axis (A) parallel to the direction in which the vehicle body (26) moves when passing through said oven module (30) and having a length (B) and including a fixed end (32) and an expanding end (34), said oven modules (30) disposed in serial relationship with one another, at least one of said oven modules (30) defining a heat-up zone (36) and at least one of said oven modules (30) defining an equalization zone (38) and at least one of said oven modules (30) defining a hold zone (40), each of said oven modules (30) including a base (42), a structural member (44) located below said base (42) of each of said oven modules (30) defining a base cavity (46) between said base (42) and said structural member (44) of each of said oven modules (30), a base insulating material (48) disposed in said base cavity (46) for restricting heat loss from said base (42), each of said oven modules (30) including an interior shell (52) and an outer shell (54) defining a pair of walls (50) extending vertically away from said base (42) between a wall bottom end (60) and a wall top end (58), said outer and interior shells (54, 52) being spaced from one another and defining a wall cavity (56) therebetween, said outer shell (52) and said interior shell (52) each defining a shell interior (134), said wall bottom ends (54) engaging said base (42), a ceiling (62) extending between said wall top ends (58) parallel to said base (42), said base (42) and said pair of walls (50) and said ceiling (62) defining an oven interior (98), said outer shell (54) defining an outer shell inner surface (70) and an outer shell outer surface (72) and said interior shell (52) defining an interior shell inner surface (74) and an interior shell outer surface (76), a pair of C-shaped channels (78) disposed on opposing sides of said oven modules (30) and extending along said length (B) of each of said oven modules (30) and engaging said base (42) and said structural member (44) and said outer shell outer surface (72) for providing support during shipping and installation, a plurality of Z-shaped rails (84) disposed in said wall cavity (56) and axially extending along said length (B) of said oven modules (30), each of said Z-shaped rails (84) having a first rail leg (86) and a second rail leg (88), said first rail legs (86) of said Z-shaped rails (84) fixedly engaging said outer shell inner surface (70), said wall top ends (58) forming an L-shape to define said ceiling (62), a shell insulating material (64) disposed in said wall cavity and said shell interior (134) of said outer shell (52) and said interior shell (52) to define three layers of insulating material for restricting heat loss from said walls (50) and said ceiling (62), said shell insulating material (64) having staggered seams for reducing concentrated areas of heat on said wall 50 and ceiling (62), said ceiling (62) defining a plurality of openings (80) having a rectangular shape, a plurality of explosion relief plugs (82) having a rectangular shape each sealingly disposed in one of said openings (80), a pair of U-shaped radiant heating tubes (100) disposed in each of said oven modules (30) for heating said oven interior (98), each of said radiant heating tubes (100) being disposed adjacent to said base (42) and one of said walls (50), each of said radiant heating tubes (100) including a first tube leg (102) entering said oven modules (30) at one of said ends (32, 34) at an angle and extending axially along said oven length (B), each of said radiant heating tubes (100) further including a U-shaped portion (104) adjacent one of said ends (32, 34) of said oven module (30) and a second tube leg (106) extending back along said oven length (B) and exiting said oven module (30) adjacent to said first tube leg (102), said first tube leg (102) of each of said radiant heating tubes (100) being positioned lower than said second tube leg (106) of said radiant heating tube (100), each of said radiant heating tubes (100) being steel with raw steel exposed for providing high emissivity, each of said radiant heating tubes (100) having a tube outer surface (92), a natural gas burner (108) disposed outside of each of said oven modules (30) for providing heat to said radiant heating tubes (100), said natural gas burner (108) defining a burner inlet (110) for receiving air, said first tube leg (102) of each of said radiant heating tubes (100) connected to said natural gas burner (108), a control system (112) connected to said natural gas burners (108) for firing said burner with pulse control or high/low control, a plurality of temperature control sensors (114) engaging said tube outer surface (92) of each of said radiant heating tubes (100) and in communication with said control system (112) for monitoring the temperature of said tube outer surface (92) of said radiant heating tubes (100), at least one high temperature sensor (116) engaging said outer surface of each of said radiant heating tubes (100) and in communication with said control system (112) for disabling said natural gas burner (108) when a predetermined maximum temperature of said outer surface of said radiant heating tubes (100) is reached, each of said temperature control sensors (114) and said high temperature sensors (116) being welded to said tube outer surface (92) of said radiant heating tubes (100), said second tube leg (106) of said radiant heating tubes (100) defining an exhaust outlet (118) disposed outside of each of said oven modules (30), a heat exchanger (120) disposed outside of each of said oven modules (30) and in fluid communication with said exhaust outlet (118) and said natural gas burner (108) for transferring heat from the exhaust air from said exhaust outlet (118) to the air entering said burner inlet (110) of said natural gas burner (108), a convection air heater (122) disposed outside of each of said oven modules (30) for providing heated convection air to said oven interior (98), a pair of lower convection ducts (124) disposed above said base (42) and extending along the length (B) of each of said oven modules (30) and connected to said convection air heater (122) for directing heated convection air at a lower temperature than said radiant heating tubes (100) at the lower part (22) of the vehicle body (26) and for preventing radiant heat from said radiant heating tubes (100) from overheating the vehicle body (26), a plurality of upper convection ducts (126) disposed in at least one of said oven modules (30) adjacent to said walls (50) and said ceiling (62) of said oven modules (30) and connected to said convection air heater (122) for directing heated convection air at the upper part (20) of the vehicle body (26) and for directing heat at the vehicle interior (28) for equalizing a temperature profile of the vehicle body (26), a pair of convection return air assemblies (128) disposed in each of said oven modules (30) and defining a passage and extending axially along said length (B) of each of said oven modules (30), each of said convection return air assemblies (128) having a return air outer surface (94), said return air outer surface (94) defining at least one return air duct (130) into said passage for removing exhaust air from said oven interior (98), and characterized by, said convection return air assembly (238) being disposed adjacent to said base (42) and one of said side walls (50) with said return air outer surface (94) of said convection return air assembly (128) extending in a trough shape to define a channel partially surrounding said radiant heating tube (100) for reflecting radiant heat from said radiant tube (100) toward the lower part (22) of the vehicle body (26), said return air outer surface 94 of said convection return air assemblies 128 extending from a first horizontal surface being parallel to said base (42) to a first bend to an intermediate surface extending at an angle from said horizontal surface to a second bend to a vertical surface being parallel to said wall (50) to define said channel, said first tube leg (102) of each of said radiant heating tubes (100) being disposed adjacent to said first bend of said return air outer surface (94) and said second tube leg (106) of each of said radiant heating tubes (100) disposed adjacent to said second bend of said return air outer surface (94).

* * * * *